US009404213B2

(12) United States Patent
Kappler

(10) Patent No.: US 9,404,213 B2
(45) Date of Patent: Aug. 2, 2016

(54) LAUNDRY APPLIANCE STORAGE CONTAINER AND METHOD FOR FRESHENING CONTENTS THEREOF

(75) Inventor: Jerrod Aaron Kappler, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1008 days.

(21) Appl. No.: 13/292,400

(22) Filed: Nov. 9, 2011

(65) Prior Publication Data

US 2013/0115130 A1 May 9, 2013

(51) Int. Cl.

| | |
|---|---|
| ***D06F 95/00*** | (2006.01) |
| ***D06F 58/20*** | (2006.01) |
| ***D06F 58/28*** | (2006.01) |
| *D06F 37/08* | (2006.01) |
| *D06F 58/04* | (2006.01) |

(52) U.S. Cl.

CPC ..... *D06F 95/002* (2013.01); *D06F 58/20* (2013.01); *D06F 58/203* (2013.01); *D06F 58/28* (2013.01); *D06F 37/08* (2013.01); *D06F 58/04* (2013.01); *D06F 2058/2854* (2013.01)

(58) Field of Classification Search

CPC ..... D06F 95/00; D06F 95/02; D06F 58/20; D06F 35/00; D06F 2058/2854

USPC ..... 68/12.02, 12.27, 140, 237

See application file for complete search history.

(56) References Cited

U.S. PATENT DOCUMENTS

| | | | | | |
|---|---|---|---|---|---|
| 3,039,286 | A * | 6/1962 | Shelton | D06F 29/00 | 137/312 |
| 3,145,551 | A * | 8/1964 | Ziegler | 68/4 | |
| 3,209,560 | A * | 10/1965 | Shelton | D06F 13/00 | 68/14 |
| 3,748,177 | A * | 7/1973 | Neumann et al. | 134/30 | |
| 3,840,998 | A * | 10/1974 | Marcussen | D06F 58/04 | 34/128 |
| 5,253,493 | A * | 10/1993 | Ohashi | D06F 39/14 | 220/812 |
| 7,007,409 | B2 * | 3/2006 | Moschutz et al. | 34/602 | |
| 7,028,415 | B2 * | 4/2006 | Heinzen et al. | 34/312 | |
| 7,404,303 | B1 * | 7/2008 | Barbosa et al. | 68/3 R | |
| 2004/0118013 | A1 * | 6/2004 | Kohlman et al. | 34/595 | |
| 2007/0084254 | A1 | 4/2007 | Messina | | |
| 2009/0211108 | A1 * | 8/2009 | Moschutz et al. | 34/491 | |
| 2010/0000578 | A1 * | 1/2010 | Hendrickson et al. | 134/34 | |
| 2010/0205819 | A1 * | 8/2010 | Ashrafzadeh et al. | 34/380 | |
| 2011/0094902 | A1 * | 4/2011 | Delehey | D06F 95/002 | 202/216 |

FOREIGN PATENT DOCUMENTS

| | | | | |
|---|---|---|---|---|
| EP | 1690973 | A1 * | 8/2006 | |
| EP | 1911871 | A2 | 4/2008 | |
| WO | WO 2006114341 | A2 * | 11/2006 | D06F 58/04 |
| WO | WO 2009022223 | A2 * | 2/2009 | A47L 15/44 |

* cited by examiner

*Primary Examiner* — Joseph L Perrin

(74) *Attorney, Agent, or Firm* — Dority & Manning, P.A.

(57) ABSTRACT

A removable storage container that may be stored inside an appliance when the appliance is not in use or when the appliance is operated in a freshening mode, a laundry appliance that incorporates such storage container, and a method for freshening the clothes and/or other articles.

14 Claims, 15 Drawing Sheets

LAUNDRY APPLIANCE STORAGE CONTAINER AND METHOD FOR FRESHENING CONTENTS THEREOF

BACKGROUND OF THE INVENTION

The subject matter disclosed herein relates generally to appliances and more particularly, to a storage container that may be used to store clothes and/or other articles within a washing machine or dryer, a laundry appliance that incorporates such storage container, and a method for freshening the clothes and/or other articles.

Laundry appliances such as clothes washing machines and clothes dryers come in various configurations, including top load and front load configurations that define by their orientation the way in which a user loads articles into the machine. Regardless of the configuration, however, washing machines generally include a housing or a cabinet in which a wash tub is disposed for containing wash and rinse water. The housing includes a top or side cover with an opening to provide access to the tub. A lid is attached to the cover for movement between open and closed positions of the washing machine. A wash basket that receives the articles is rotatably mounted within the wash tub, and in certain configurations an agitating element is rotatably positioned within the wash basket.

Many laundry rooms are small, without much room to store clothes and other articles that need washing. This means that many users must use valuable space within the laundry rooms to store such clothing and/or articles until is time to wash them.

A need therefore exists for a removable storage container that may be stored within a laundry appliance when the appliance is not in use, which maximizes storage of articles inside the appliance, and which addresses the lack of space in a laundry room without modifying the functionality or the dimensions of the appliance.

BRIEF DESCRIPTION OF THE INVENTION

As described herein, the exemplary embodiments of the present invention overcome one or more disadvantages known in the art.

For example, storing clothing and/or other articles within a removable storage container inside a laundry appliance, such as a washing machine or dryer when not in use, helps maximize the organization space of a laundry room, benefiting the consumer. Embodiments of the removable storage container permits storage of clothing and/or other articles inside the appliance and addresses the lack of space in a laundry room without modifying the functionality or the dimensions of the appliance that receives the removable storage container.

The storage container may be custom fit to the appliance to maximize the storage of clothing and/or other articles inside the appliance when the appliance is not in use. Such a container may also be used to freshen clothing or other articles when used with a laundry appliance capable of operation in a "freshening" mode. A laundry appliance may be configured in various ways to accommodate such a container. For example, in one embodiment when the storage container is inserted into the appliance, the appliance senses the presence of the storage container. In such an embodiment, the storage container may have a magnet or other device that indicates to a main control system of the appliance whether or not the storage container is inside the appliance, which would prevent operation of the appliance while the storage container is within the appliance. The storage container can be removed from the appliance before one or more operating cycles are run.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF EXEMPLARY EMBODIMENTS OF THE INVENTION

Described herein are embodiments of an apparatus and method for temporarily storing clothing and/or other articles inside an appliance, such as a clothes washing machine or a clothes dryer. In one embodiment, the apparatus is a removable storage container that can be stored inside the appliance to maximize space in a laundry room. The storage container may be custom fit to the appliance, so that one or more articles can be stored inside the appliance when the appliance is not in use, and/or may be freshened when the appliance is operated in a "freshening" mode. The one or more articles may comprise, but are not limited to, clothing, linens, footwear, etc. The storage container may have a magnet or other device that indicates to a main control system of the appliance whether or not the storage container is in the appliance. This indication can be used by a computer processor associated with the appliance to initiate (and/or prevent) one or more cycle activations of the appliance while the storage container remains inside. As an example of a cycle that can be initiated, a signal outputted from a storage container sensor may command the appliance to operate in a "freshening" mode, during which one or more elements of the storage container, such as an impeller, are operated to create airflow within appliance and/or through and/or around the storage container. The same or different signal from the storage container sensor may additionally, or alternatively, prevent the appliance from operating in a typical operating mode, such as a wash cycle, a spin cycle, etc., in which case, the storage container can be removed from the appliance before such cycles are run.

Figure 1:
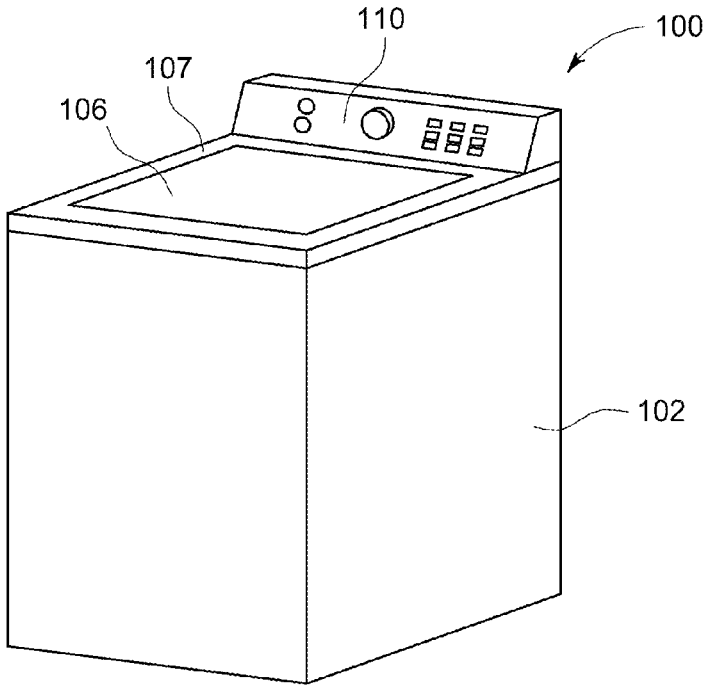
FIG. 1 is a perspective view of an exemplary top load washing machine.

For context and to begin the discussion, reference can be had to FIG. 1 in which there is depicted a perspective view of an exemplary embodiment of an appliance 100, and more particularly a top load or vertical axis washing machine 102 that embodies the concepts of the present invention. It is contemplated however and a person of ordinary skill in the art understands that at least some of the benefits of the concepts recited herein can be realized in other types of appliances, including, without limitation, front load or horizontal-axis washing machines, front load clothes dryers, and top load clothes dryers. These concepts are therefore not intended to be limited to any particular type or configuration of the appliance 100, such as the configuration and features of the vertical-axis washing machine 102, which is shown merely for illustration.

Figure 2:
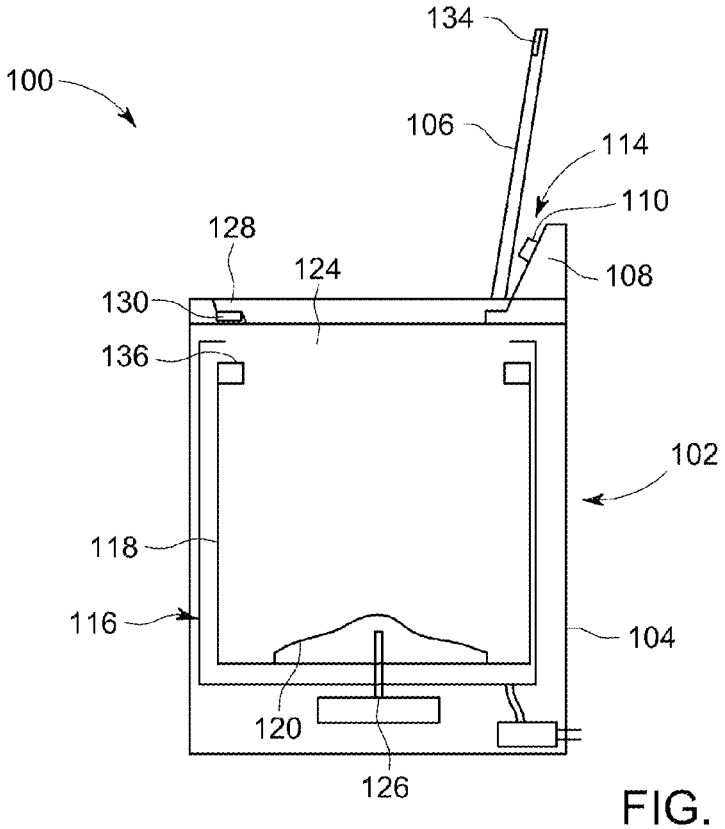
FIG. 2 is a side view of an exemplary top load washing machine.

FIGS. 1 and 2 illustrate an exemplary appliance 100 that embodies one or more features of the present invention. FIG. 1 shows a perspective view of an exemplary top load washing machine 102 which includes a cabinet 104, lid opening 106, and control panel 110. FIG. 2 shows a cross-sectional side elevation of an exemplary top-loading washing machine 102 similar to that depicted in FIG. 1. In the exemplary embodiment shown in FIG. 2, the vertical-axis washing machine 102 includes a cabinet 104, a cover 107 or lid opening 106, and a backsplash 108 extending from the cover 107. A control panel 110, including a plurality of input selectors 112, is coupled to the backsplash 108. The control panel 110 and the input selectors 112 collectively form a user interface input for operator selection of appliance cycles and/or features. The control panel 110 may include, or be coupled with, the computer processor referenced herein. Optionally, the washing machine 102 may further include a display 114 indicating selected features, a countdown timer, and/or other items of interest to a user.

Also shown in FIG. 2, a wash tub 116 is located within the cabinet 104. Inside of the wash tub 116 is a wash basket 118, which is movably disposed and rotatably mounted in the wash tub 116 in a spaced apart relationship from wash tub 116. An agitator 120 can be rotatably positioned in the wash basket 118 on a vertical axis, which is substantially aligned and coincident with a center axis (not shown) of the wash basket 118. In one embodiment, the agitator 120 is configured to impart oscillatory motion to articles and liquid in the wash basket 118 and the wash basket 118 is driven by a motor drive system 126. Articles such as dirty clothes are loaded through the opening 124 of the washing machine 102. The washing machine 102 further comprises a lid position sensor 130, a lid recess 128, a lid magnet 134 and a balance ring 136, which will be discussed in connection with later described figures.

As can be seen from FIG. 2, the washing machine 102 has space within the cabinet 104 that can be used for storage when the washing machine 102 is not in use. Accordingly, one benefit of the storage container described herein is that it fits within and utilizes some of the space inside the washing machine 102 when the washing machine 102 is not in use. This can be advantageous to a user of the washing machine 102, because it frees up space within the laundry room that would otherwise be needed to store clothes and/or other items between wash (or drying) cycles.

Figure 4:
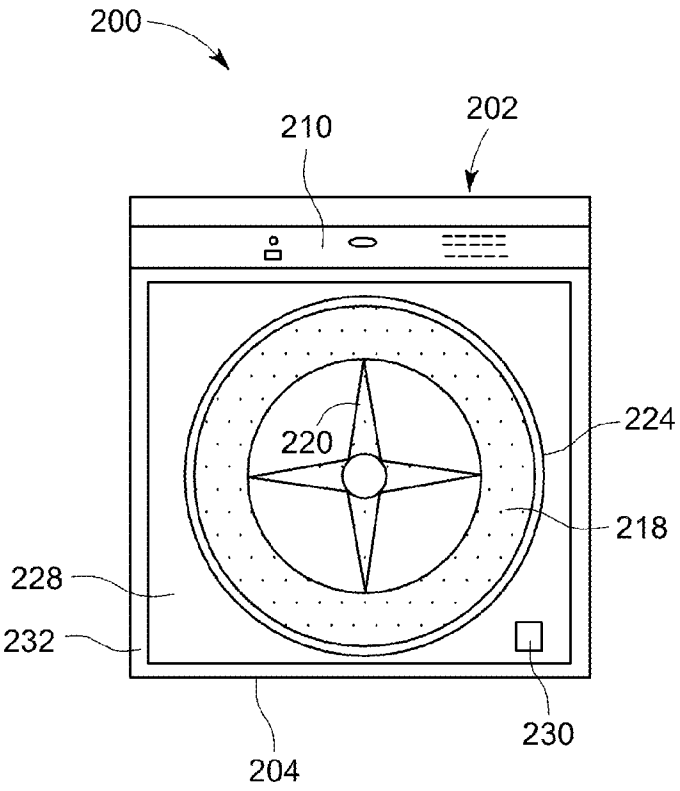
FIG. 4 is a top view of an exemplary top load washing machine with a full access opening.
Figure 3:
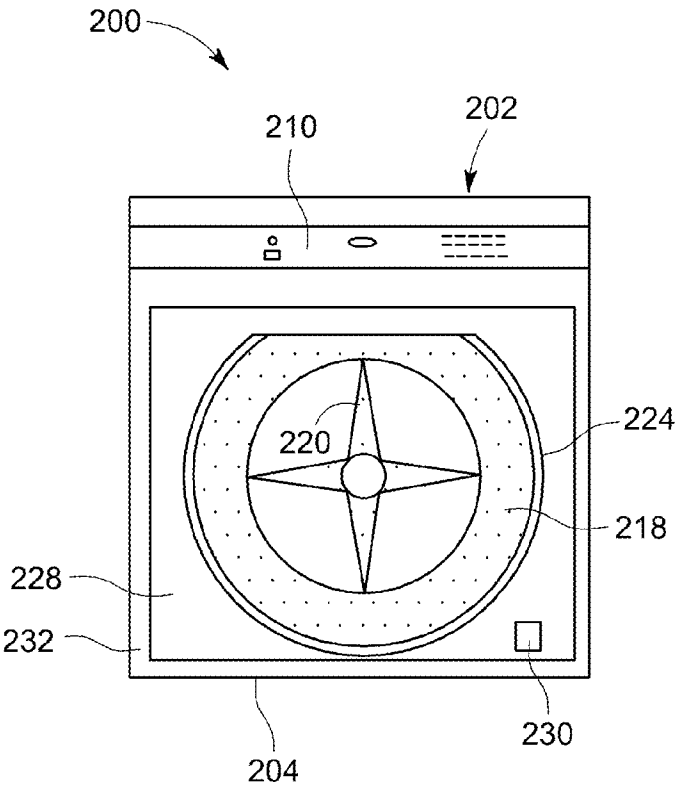
FIG. 3 is a top view of an exemplary top load washing machine with a partial access opening.

FIGS. 3 and 4 are embodiments of top views of the washing machine 102 shown in FIG. 1. As shown in FIGS. 3 and 4, the washing machine 202 includes a cabinet 204, a top surface 232 of the washer, a lid recess 228 within the interior of the cabinet 204, a lid position sensor 230, and a control panel 210 extending from the top surface 232 of the washer 202. The wash extraction basket 218 is located within both the cabinet 204 and the opening 224, and within the wash extraction basket 218 is the agitator 220. In one embodiment as shown in FIG. 4, opening 224 and the opening of the washing machine 202 may be completely curved, providing a full access opening. In an alternate embodiment shown in FIG. 3, the opening 224 and the opening of the washing machine 202 may comprise both a circular or curved portion and flat portion located towards the control panel side 210 of the washing machine 202, forming a "D" shape. The shape of the opening 224 and the opening of the washing machine 202 can influence (or dictate) the general outer shape of the storage container shown in FIGS. 5, 6, 7, 8, 9, 10 and 11.

Figure 6:
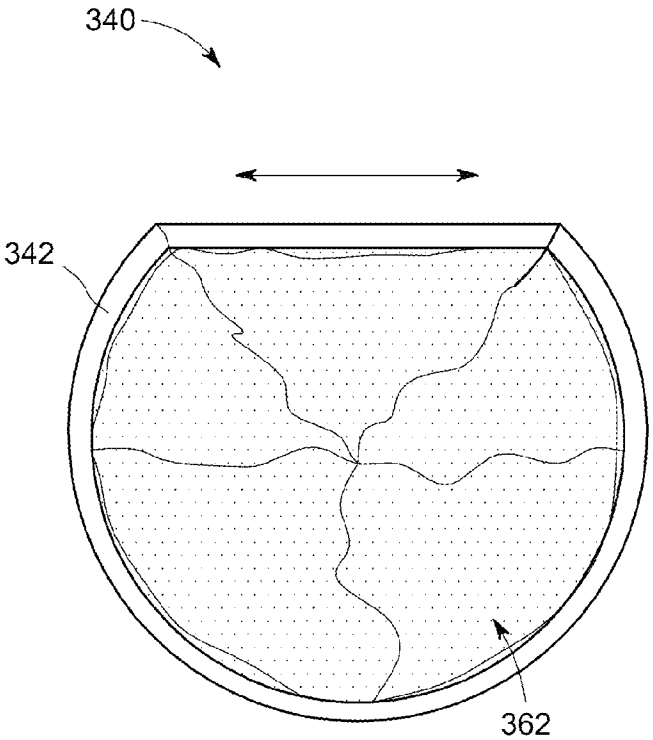
FIG. 6 is a top view of an exemplary laundry bag.
Figure 5:
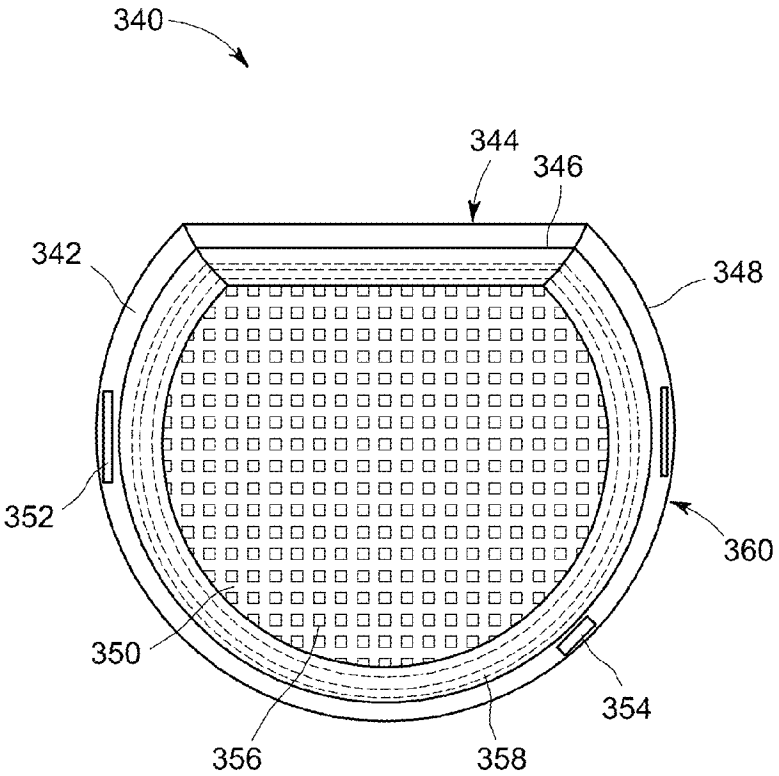
FIG. 5 is a top view of an exemplary storage container.
Figure 7:
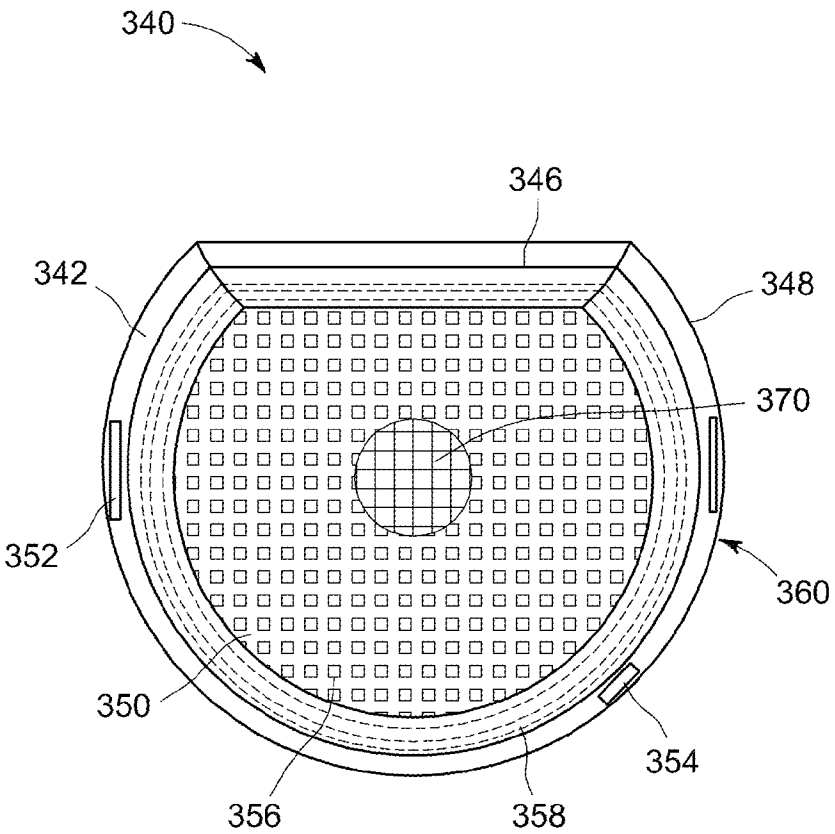
FIG. 7 is a top view of an exemplary storage container with a deodorizing compartment.

FIGS. 5, 6, 7, 8, 9, 10 and 11 are exemplary embodiments of a storage container 340, 440. FIGS. 5, 6 and 7 show top views of the exemplary storage container 340. FIGS. 8, 9, 10 and 11 depicts side views of the exemplary storage container 440 shown in FIGS. 5, 6 and 7. In one embodiment as shown in FIG. 5, the exemplary storage container 340 may be a basket 360, which comprises a support rim 342, walls 344, and a bottom 350. The support rim 342 and the walls 344 of the basket 360 may correspond to the shape of the opening 224. The basket 360 may be made from a variety of materials known in the art, such as plastic, stainless steel, painted steel, and aluminum. However, the basket 360 should not be made of materials that are water soluble or chemically non-resistant. The basket 360 may be made from standard manufacturing techniques; for example if the basket is plastic, it may be injection molded or thermally formed. Alternatively, if the basket 360 is metal, steel, or aluminum, it may be welded, mechanically fixed, or drawn.

The support rim 342 can be rigid or semi-rigid in structure. The support rim 342 may be designed to fit around the lid recess 228 (shown in FIG. 3) of the opening 224 of the washing machine 202. In such an embodiment, the support rim 342 is larger than the diameter of the opening 224 of the washing machine 202, such that the support rim 342 rests on material that forms the opening 224 of the washing machine 202. In one embodiment, the support rim 342 and the walls 344 are both curved 348 and flat 346, and form the same "D" shape as shown in FIG. 3. Alternatively, the rim 342 and walls 344 may be only curved.

Figure 8:
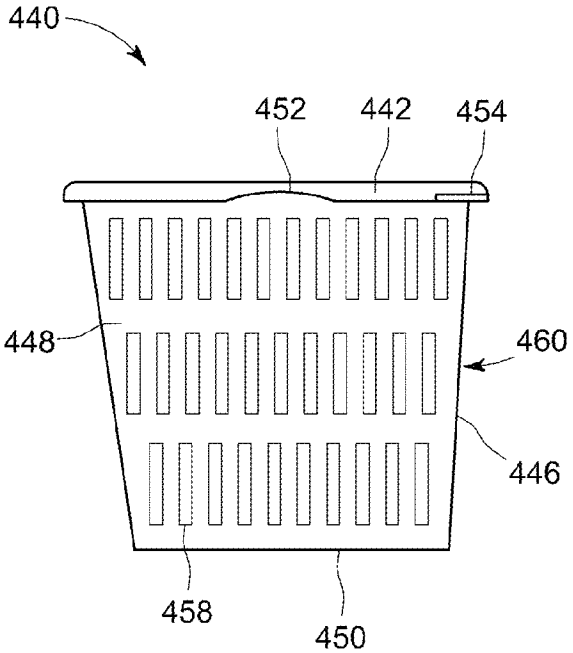
FIG. 8 is side view of the exemplary storage container of FIG. 5.
Figure 10:
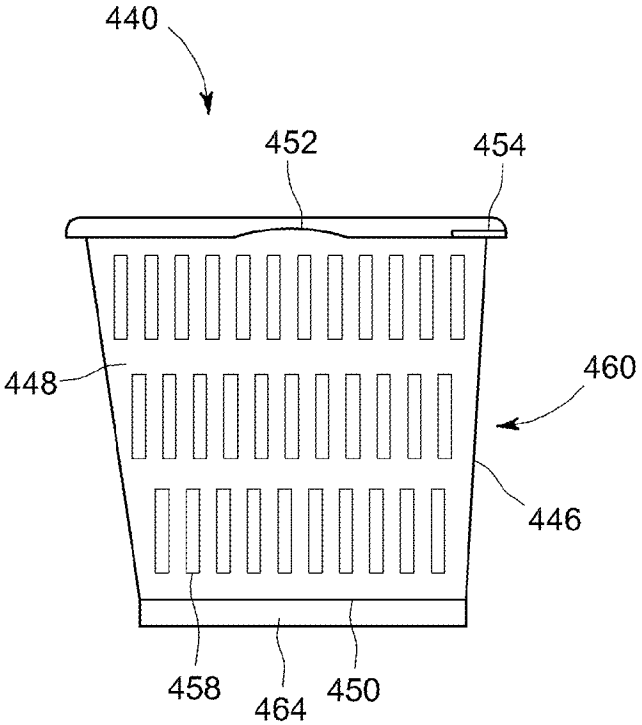
FIG. 10 is a side view of an exemplary storage container with a sitting surface.

FIGS. 8 and 10 more clearly show the curved wall 448 and flat wall 446 of the basket 460. The walls 344 are rigid, and may be made from any material such as plastic and wire. The geometry of the rim 342 and the walls 344 of the basket is dependent upon the geometry of the opening 224 of the machine 202 as shown in FIGS. 3 and 4. For example, if the shape of the opening of the washing machine 202 is entirely curved, as shown in FIG. 4, then the basket 360 has a rim 342 and walls 344 that are completely curved 348. However, if the shape of the opening of the washing machine 202 is both curved and flat, with a "D" shape, as shown in FIG. 3, then the basket 360 may have a rim 342 and walls 344 that are both flat 346 and curved 348, as shown in FIG. 5. The shape of storage container 340, 440 and the rim 342 is dependent upon the shape and geometry of the opening 224 and the opening of the washing machine 202 shown in FIGS. 3 and 4, and is designed to allow the lid (or door) of the washing machine to close when the storage container 340, 440 is inside.

Referring again to FIG. 5, the basket 360 also comprises at least one handle 352, which is attached to the support rim 342. The handle 352 may be located along any portion of the support rim 342 and is designed to allow the user to move the basket 360 from one location to another. The handle 352 is further described in FIGS. 12, 13, 14 and 15. The handle 352 may be of any shape and size that allows a user to easily transport the basket 460 and remove the basket from the appliance 100, and which does not interfere with the ability of the storage container 340, 440 to fit within the opening 224 and the opening of the washing machine 202 while still allowing the lid of the machine to close when the basket 360 is inside. For example, the handle 352 may comprise finger grips, or may be of various configurations, such as but not limited to folding or telescoping, and provide for up and down movement of the handle 352.

A magnet pocket 354 may be housed within the basket 360. The magnet pocket 354 is used in conjunction with the sensor 230 on the washing machine 202, as shown in FIGS. 2 and 3. The magnet pocket 354 may house a magnet 334 or other device that indicates to a computer processor associated with the washing machine 202 whether or not the storage container 340 is in the washing machine 202. Such an indication can be used by the computer processor to prevent specific cycle activation while the storage container 340 is within the washing machine 302. Hence, when the basket 360 is detected to be within the washing machine 202, the computer processor can disable various cycle activities from starting, such as high speed spin. In one embodiment, as shown in FIGS. 8 and 10, the magnet pocket 454 may be molded into the bottom of the support rim 442 of the basket 460.

As shown in FIGS. 5, 6 and 7, the basket 360 may further comprise bottom ventilation and drain holes 356 and wall ventilation and drain holes 358. The holes allow for air to escape through the basket 360. As shown in FIGS. 8 and 10 the ventilation holes 456, 458 can have a rectangular shape. However, in practice, the ventilation holes 456, 458 may be of any suitable shape and/or size.

In one embodiment, as shown in FIG. 10, the basket 460 may further comprise a ring 464 around the bottom of the basket 460. The ring 464 is attached to the bottom 450 of the basket and provides a sitting surface for the basket 460 to rest on a bottom of the wash basket of the machine 302. The ring 464 may be made from the same material as the basket 460.

Figure 9:
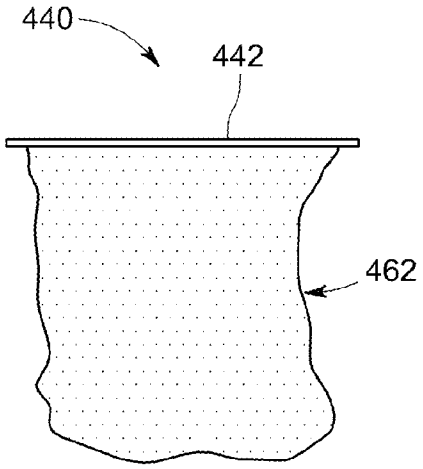
FIG. 9 is a side view of the exemplary laundry bag of FIG. 6.

In an alternate embodiment, as shown in FIGS. 6 and 9, the exemplary container 340, 440 may be a laundry bag 362, 462. The laundry bag 362, 462 is comprised of a support rim 342,442 as previously described in connection with FIG. 5 which is attached to a bag. The bag 362,462 may be detachable from the rim 342,442. As shown, the bag 362, 462 may comprise an adjustable draw string at the upper, open portion, which is designed to fit over the rim 342,442. The bag 362, 462 may be made of mesh, nylon or any lightweight material and may be of any shape and size that has the ability to fit within the washing machine 102, 202. The support rim 342 is rigid in structure and is designed to fit onto the rim of the opening of the washing machine 102, 202 or the lid recess 128, 228 of the washing machine 102, 202. The rim 442 may have a ring-type shape that is easily attachable to the lid recess 128 of the washing machine 102 shown in FIG. 2. This rim 442 can be supported vertically inside the lid recess 128 as in the rigid basket embodiment described above. The flexible bag portion of the storage container 340, 440 would then occupy a portion of the interior of the washing machine 102, 202, particularly if the washing machine 102, 202 had no central agitator (or had one that only protruded slightly upwards from the bottom of the wash tub).

Figure 11:
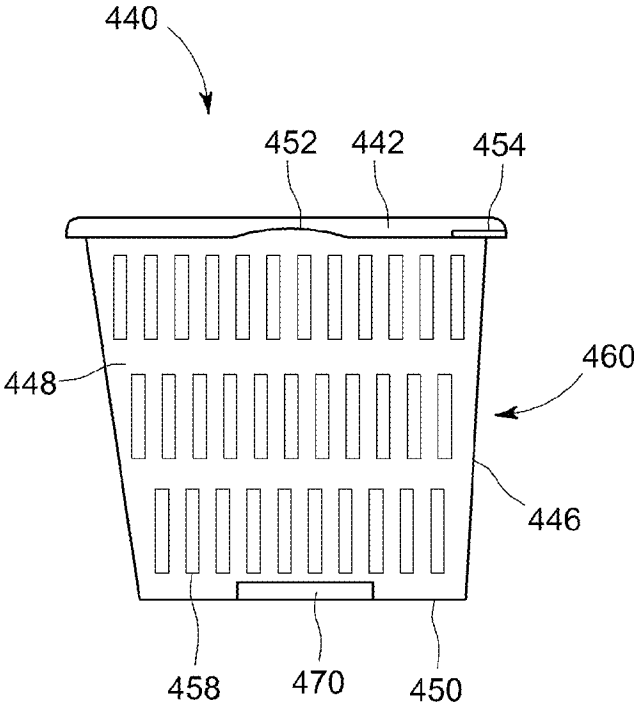
FIG. 11 is a side view of the exemplary storage container of FIG. 7.

FIG. 7 is a top view of the exemplary laundry basket 360 shown in FIG. 5, with the addition of a deodorizing compartment 370. FIG. 11 is a side view of the exemplary laundry basket shown in FIG. 10. The deodorizing compartment 370 may be located anywhere on the basket 360, such as on the side of the basket 360, near the rim 442, or on the bottom 450 of the basket 460. In one embodiment, as shown in FIG. 11, the deodorizing compartment 470 is located at the bottom 450 of the basket 460. The deodorizing compartment 370 may hold a freshener 372 that deodorizes dirty clothes and/or other articles, while they are being stored in the basket 360. The freshener 372 may be any freshener or deodorizer known in the art, including, but not limited to baking soda, a dryer sheet, or a perfume plug.

Figure 13:
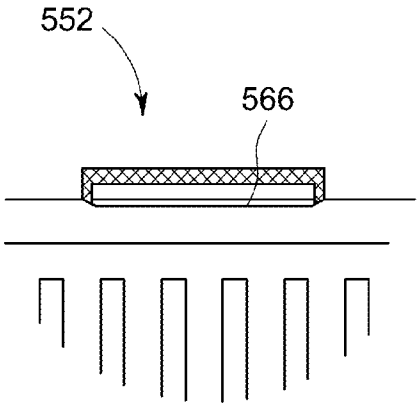
FIG. 13 is a perspective view of an exemplary storage container handle shown in the up or carrying position.
Figure 12:
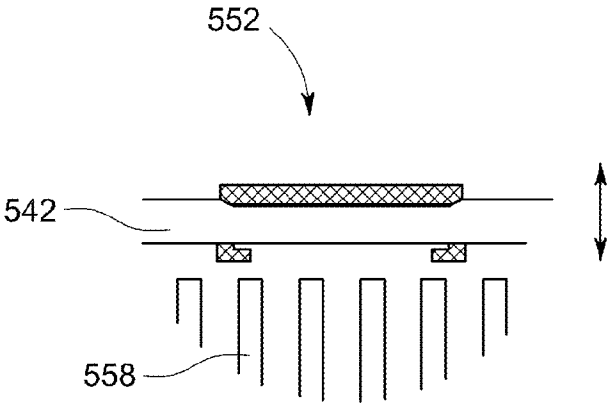
FIG. 12 is a perspective view of an exemplary storage container handle shown in the down position.

FIGS. 8, 12, 13, 14 and 15 are other embodiments of exemplary handles 452, which are similar to the handles 352 shown in FIGS. 5 and 7. In one embodiment, as shown in FIGS. 8, 10 and 11, the handle 452 may be a recessed handle which allows the user to grip the storage container 440. In this embodiment, the handle has no moving parts. In alternative embodiments, the handle may have moving parts. In an embodiment as shown in FIGS. 12 and 13, the handle 552 may be a pop-up or liftable handle. FIG. 12 is a perspective view of the exemplary storage container handle 552 shown in the down position. The handle 552 may be in the down position when the storage container 440 is resting within the washing machine 102, 202. FIG. 13 is a perspective view of the exemplary handle 552 shown in the up position. When the handle 552 is in the up position, the storage container 440 may be carried by the user from one location to another. For example, a user may raise the handle to the up position when removing the storage container 440 from storage in the washing machine 102,202 to outside of the washing machine 102, 202 when a cycle is going to be run. A pop-up or liftable handle may be desirable when a low profile of the lid of the machine does not allow for the storage container rim to be very high. A pop-up or lift-able handle 552 can be tucked away in the storage container 440 and accessed when needed by lifting the handle up, and thus only a small amount of room is needed in order to operate the handle from the down to the up position, or vice versa.

Figure 15:
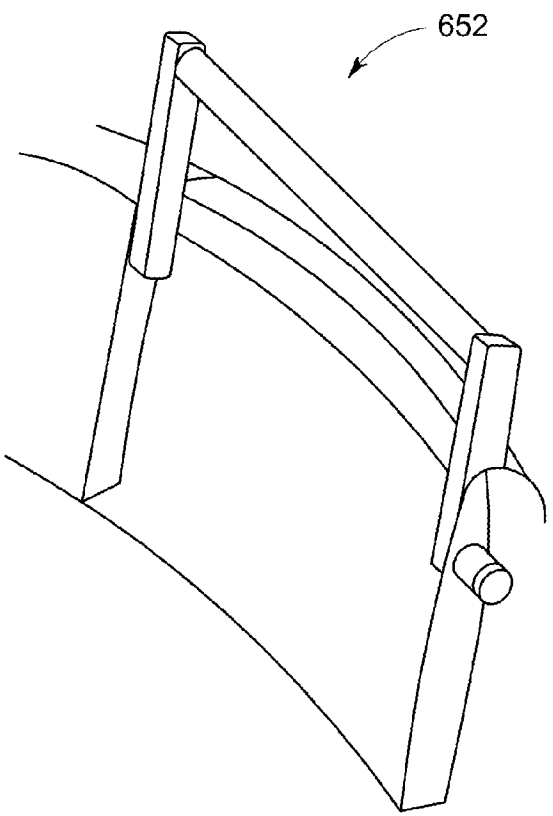
FIG. 15 is a perspective view of an exemplary storage container handle shown in the up or carrying position.
Figure 14:
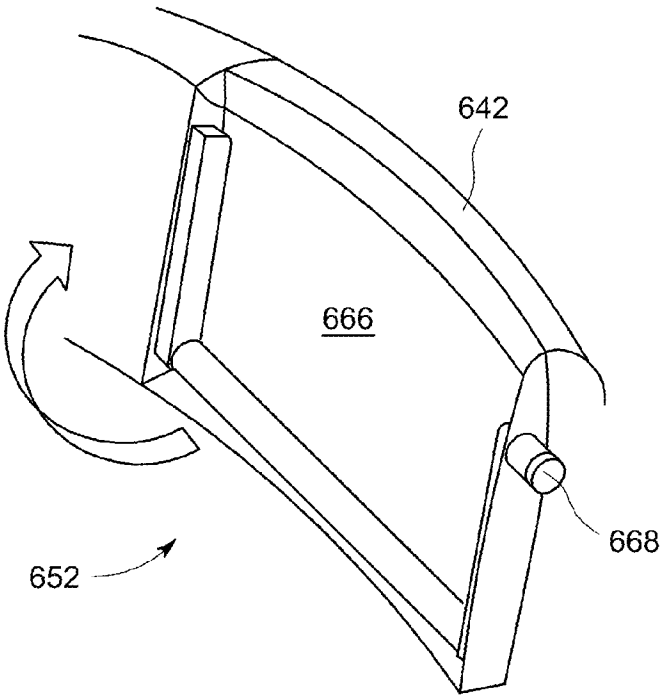
FIG. 14 is a perspective view of an exemplary storage container handle shown in the down position.

In another embodiment, as shown in FIGS. 14 and 15, the handle may employ a pivot configuration. FIG. 14 is a perspective view of an exemplary pivot handle 652 shown in the down position. When in the down position, and not in use, the pivot handle 652 is tucked or hidden within a handle recess 666 on the inner side of the basket. FIG. 15 is a perspective view of the exemplary handle shown in the up position. When the handle 652 is rotated around a pivot 668 to the up position, the storage container 440 may be carried by the user from one location to another, by grasping the handle 652, which projects beyond the storage container, similarly to that of FIGS. 12 and 13. For example, when the storage container is needed, the user would be able to lift and rotate the handle 652 to the carrying position.

Figure 16:
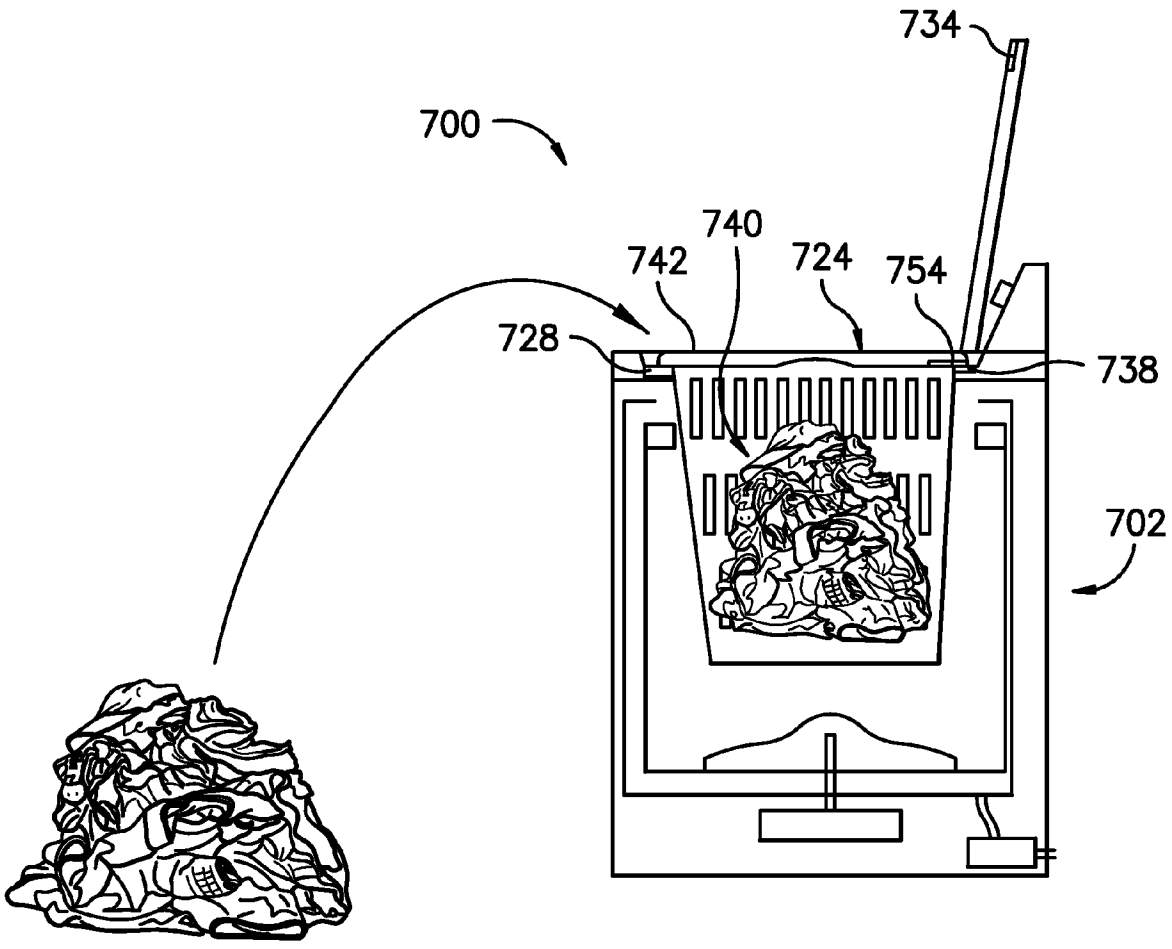
FIG. 16 is a side view of an exemplary washing machine with an exemplary storage container inside the washing machine.
Figure 17:
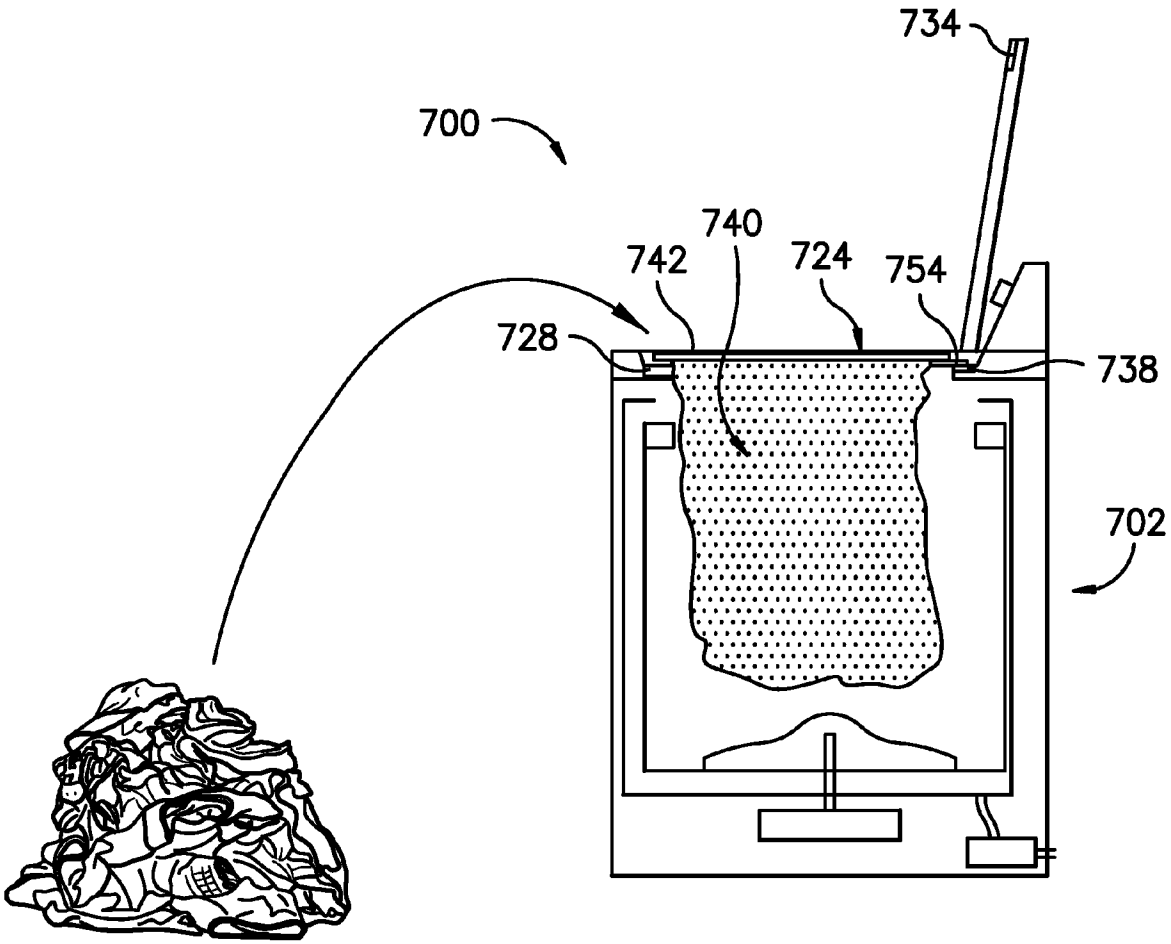
FIG. 17 is a side view of an exemplary washing machine with an exemplary laundry bag inside the washing machine.
Figure 18:
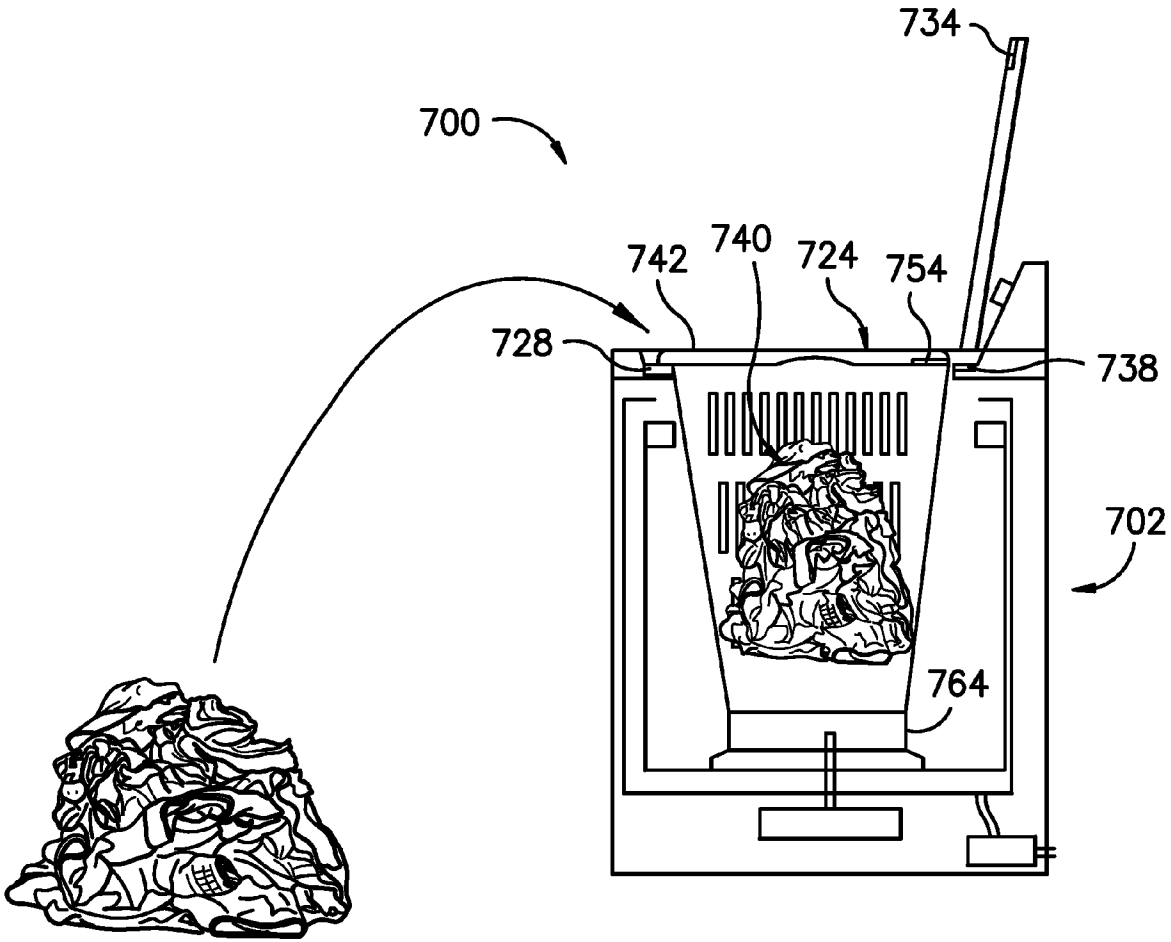
FIG. 18 is a side view of an exemplary washing machine with an exemplary storage container inside and resting on the bottom of the washing machine.
Figure 19:
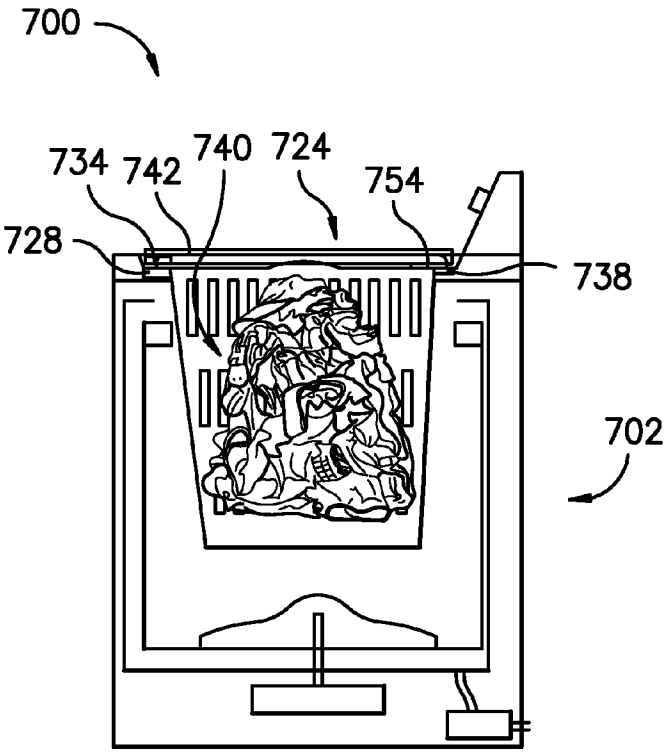
FIG. 19 is a side view of an exemplary washing machine with an exemplary storage container inside the washing machine with a top lid of the washing machine closed.

FIGS. 16, 17, 18 and 19 are side views of the exemplary containers 340, 440 of FIGS. 5 and 8 shown inside the washing machine 102, 202 of FIGS. 1 and 2. FIG. 16 is a side view of the exemplary laundry basket 360, 460 shown in FIGS. 5 and 8 inside the washing machine 702 of FIGS. 1 and 2. FIG. 17 is a side view of the exemplary laundry bag 362, 462 shown in FIGS. 6 and 9 inside the washing machine 702 of FIGS. 1 and 2. FIG. 18 is a side view of the exemplary laundry basket 360, 460 shown in FIGS. 5 and 10 inside and resting on the bottom of the washing machine 702 of FIGS. 1 and 2. FIG. 19 is a side view of the exemplary laundry baskets 360, 460 shown in FIGS. 5 and 8 inside the washing machine 702 of FIGS. 1 and 2 with a top lid 506 of the washing machine 702 closed.

As shown in FIGS. 16, 17, 18 and 19, articles, such as clothes, may be stored within the washing machine or clothes dryer 702 rather than on the floor. The storage container 740 fits within the opening 724 of the machine 702. As shown, the storage container 740 rests proximate the lid recess 728, allowing the support rim 742 of the storage container 740 to be held up by the material that forms the lid recess 728 of the machine 702. Accordingly, the lid of the machine 702 can be closed after the storage container 740 has been inserted, thereby getting the clothes out of sight and allowing for optimal use of laundry room space.

The magnet pocket 754 is in close proximity to the basket position sensor 738. Further, the magnet pocket 754 is in vertical alignment with the basket position sensor 738. The proximity of the magnet pocket 754 to the storage container position sensor 738 allows for the machine 702 to be able to sense or detect the presence of the storage container 740 within the machine 702, and thus prevent a cycle, such as a wash cycle or a spin cycle, from running. This detection method may be one of several detection means. In one embodiment, as shown with the storage container position sensor, the method uses a magnet and reed switch. In an alternate embodiment, there may be a feature on the storage container that engages a switch. In another embodiment, a metal to metal connection between the storage container and the washing machine (or dryer) is used in lieu of a switch.

Figure 20:
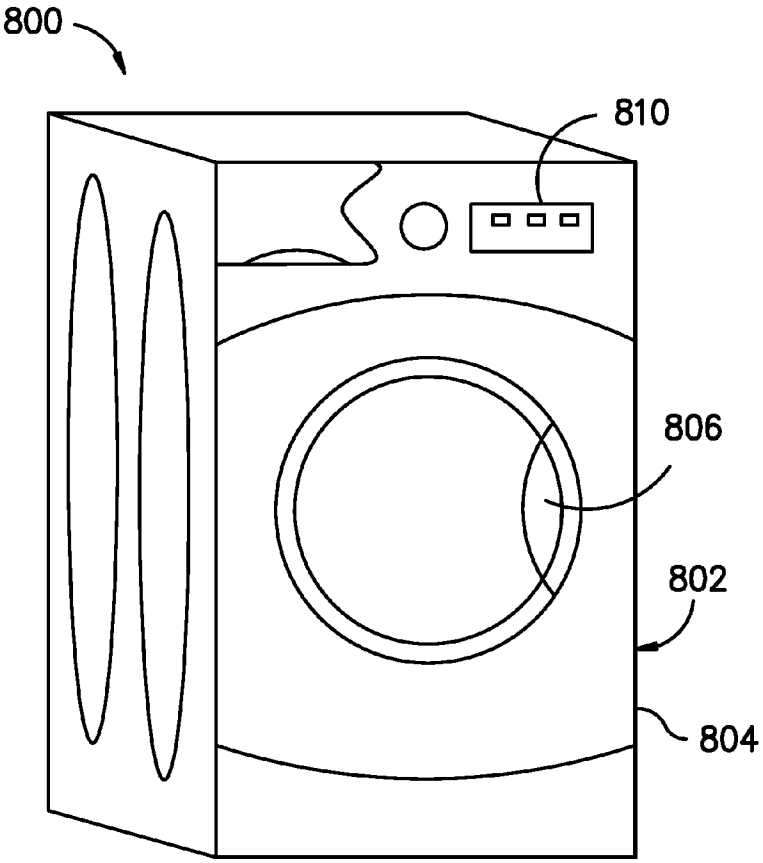
FIG. 20 is a perspective view of an exemplary horizontal axis washing machine with the front door closed.
Figure 22:
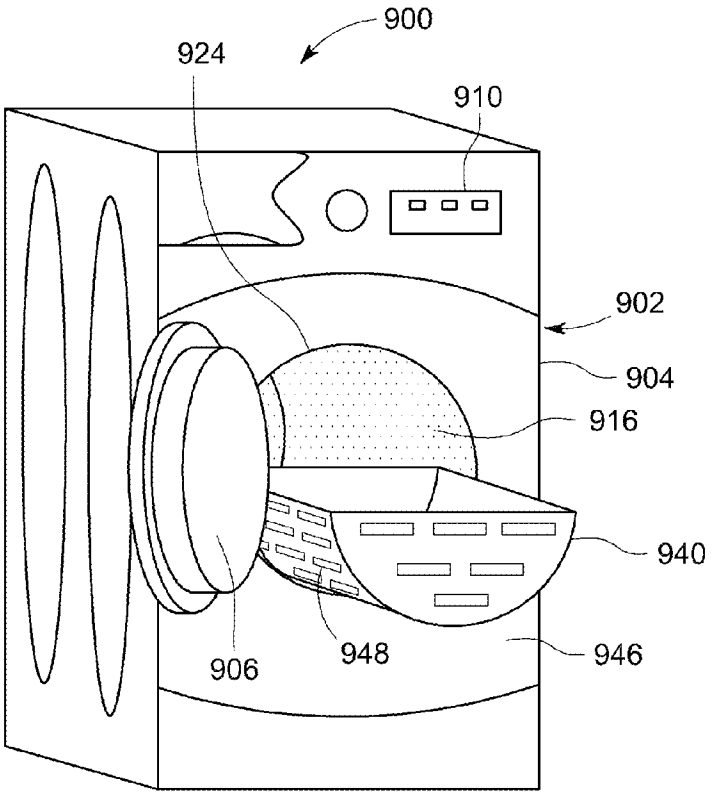
FIG. 22 is a perspective view of an exemplary horizontal axis washing machine with an exemplary storage container.
Figure 21:
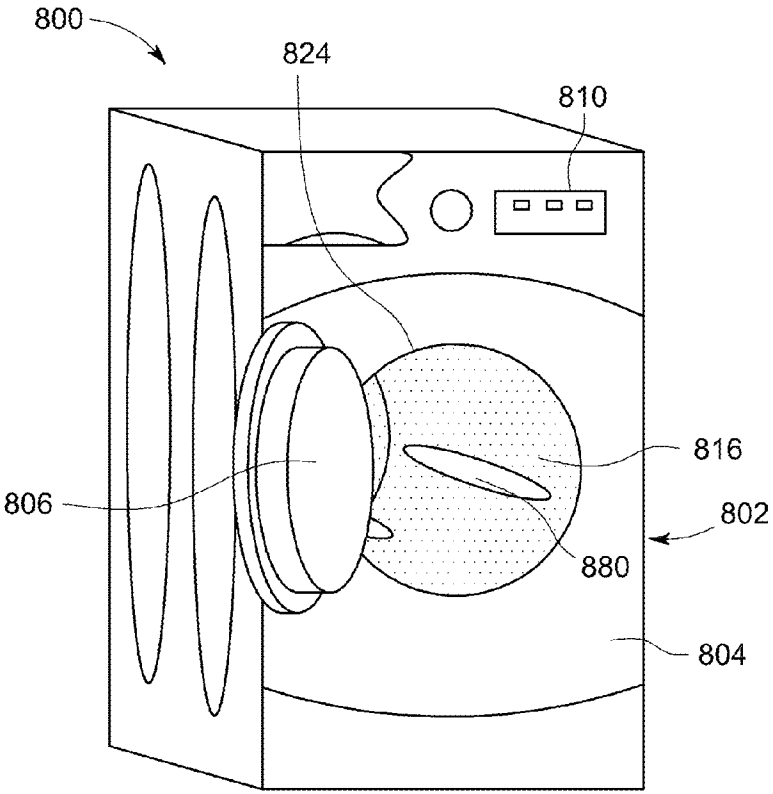
FIG. 21 is a perspective view of an exemplary horizontal axis washing machine with the front door open.

In an alternate embodiment, as shown in FIGS. 20, 21 and 22, the appliance 800,900 may be a horizontal axis washing machine. FIG. 20 is a perspective view of an exemplary horizontal axis washing machine 802 with the front door closed and FIG. 21 is a perspective view of an exemplary horizontal axis washing machine 802 with the front door open. Appliance 800,900 comprises many of the same features as previously described and shown in FIGS. 1, 2, 3 and 4, only differencing itself from FIGS. 1, 2, 3 and 4 due to the shape of the storage container 940. In one embodiment, as shown in FIG. 22, the storage container 940 may fit within the interior of the washing machine.

In one embodiment as shown in FIG. 22, the exemplary storage container 940 may be a basket 960, which comprises flat walls 946 and curved walls 948. The shape of the opening 924 of the washing machine 902 may dictate at least the outer shape of the storage container 940. The walls 946 of the storage container 940 may correspond to the same shape of the opening 924 of the machine 900. For example, as shown, the storage container 940 has both a circular or curved portion and flat portion, forming a "D" shape. The walls 946, 948 are rigid, and may be made from any material and method as previously described. The storage container 940 has a drawer-type function. Once inside the washing machine 902, the storage container 940 may rest on the clothes lifter or baffle 880 (shown in FIG. 20), allowing a user to easily slide the storage container 940 in and out of the machine 902. The storage container 940 rests on a baffle, which prevents the storage container 940 from tipping due to its weight. The diameter of the opening of many horizontal axis washing machines is less than the diameter of the clothes washing basket inside the machine. In such an embodiment, the storage container 940 can be configured and dimensioned to fit through the opening and rest on the baffles which protrude inwardly from the clothes washing basket wall.

Figure 23:
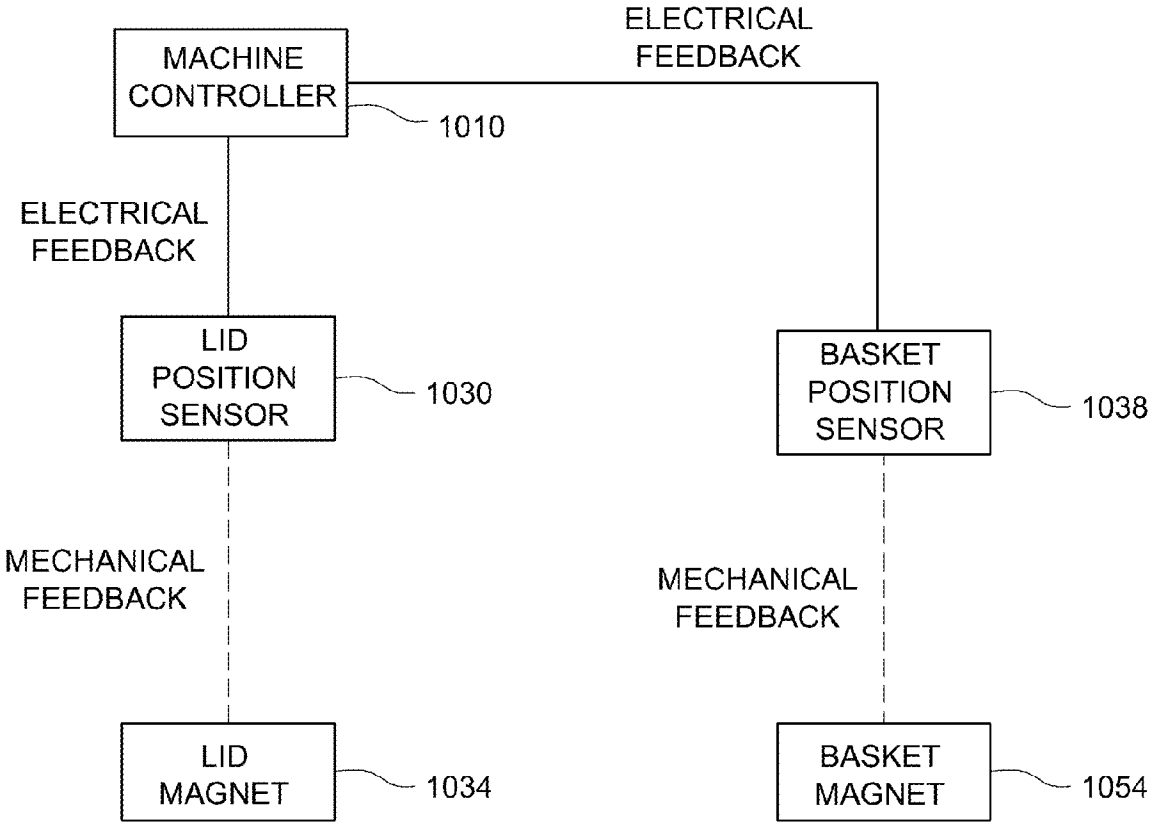
FIG. 23 is schematic view of an exemplary control system.

FIG. 23 provides a basic schematic of how the lid position sensor and the basket position sensor communicate with a washing machine or dryer. Mechanical feedback is provided between the lid position sensor and the lid magnet. A typical embodiment is the use of a reed switch and magnet. The magnet creates a magnetic flux which closes the contacts of the reed switch when in close enough proximity. The reed switch is electrically connected to the appliance control and provides the signal for lid position. Likewise, mechanical feedback is provided between the basket position sensor and the basket magnet. Electrical feedback is provided between the lid position sensor and the machine controller. Likewise, electrical feedback is provided between the basket position sensor and the machine controller.

Figure 24:
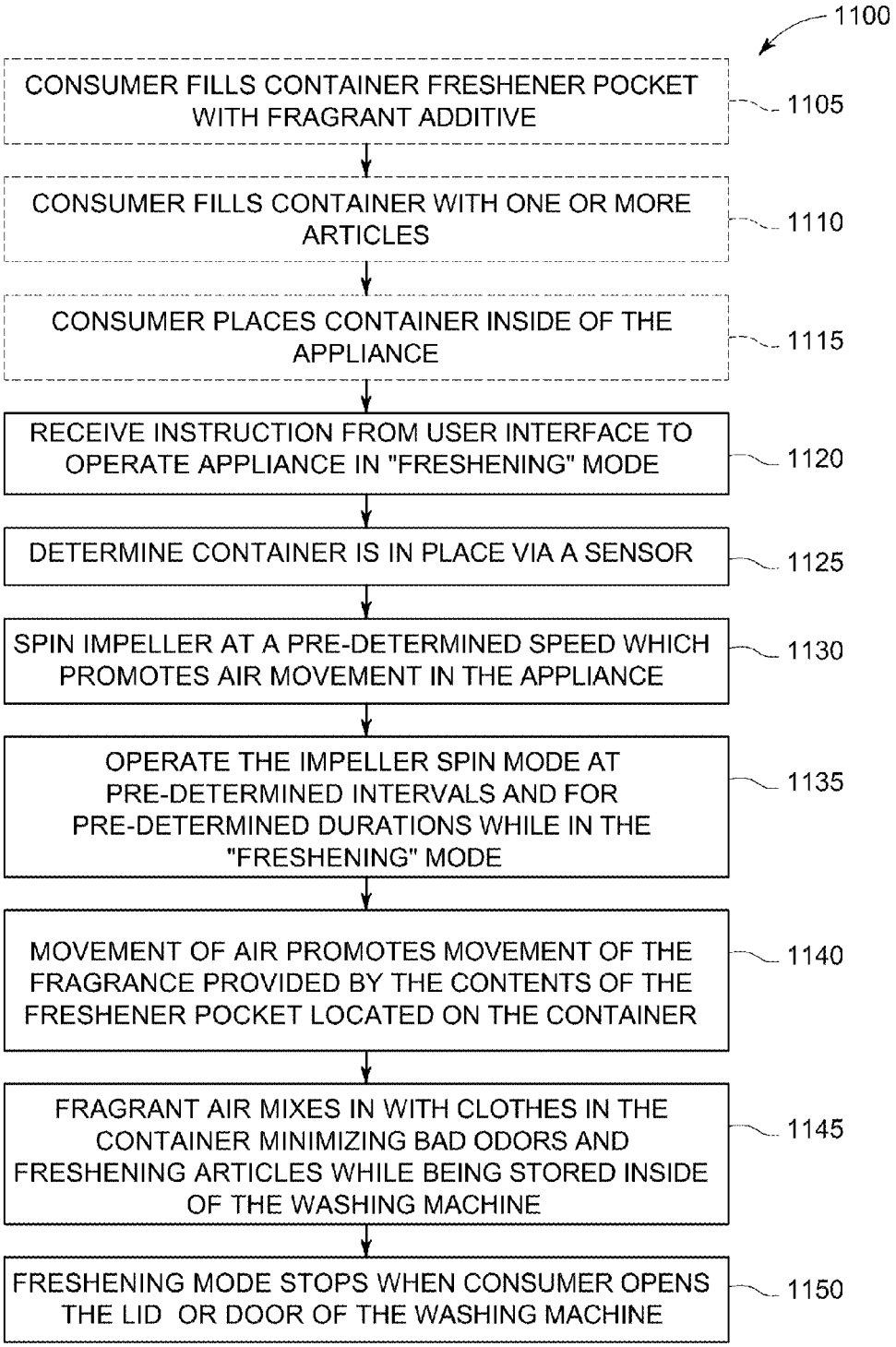
FIG. 24 is a method of freshening contents of a washing machine which contains an internal storage container.

FIG. 24 depicts an embodiment of a method 1100 of freshening contents of a laundry appliance that contains an internal container. Preferably, one or more components of the appliance 100 perform at least steps 1120, 1125, 1130 and/or 1135. Thus, an embodiment of the method 1100 may comprise steps 1120, 1125, 1130, 1135, 1140, 1145 and 1150. The other steps shown in FIG. 24 may be performed by one or more users of the appliance 100.

For example, in step 1105, a user fills a storage container freshener pocket with fragrant additive. In step 1110, the user fills the container with clothes. In step 1115, the user places the storage container inside of a machine, such as a washing machine or a dryer. In step 1120, the user closes the lid of the machine and sets a control to a "freshening" mode on the control panel. Thus, from the appliance's perspective, step 1120 includes receiving an instruction from a user interface (of the appliance) to operate the appliance in the "freshening" mode. During the freshening mode, the washer activates the drive motor and spins the impeller at a speed in the range of 5 RPM to 500 RPM for an extended period of time. The physical geometry of the impeller, in the case of a top loading washing machine, is conducive to creating air movement when spun due to the ribs extending above the horizontal surface and extend radially outward toward the periphery of the impeller. Air movement occurs as a result of the impeller spinning, promoting carrying the scent from the freshening pocket to the clothes, and/or carrying away undesirable odors from the clothes to the outside of the washing machine. Additionally, the air movement promotes moving undesirable odors to the freshening pocket, so that the odors are eliminated by the contents of the freshener pocket. A common odor absorber is baking soda. In step 1125, the appliance determines, using at least one of a lid sensor or door sensor, the storage container position sensor and the magnet, that the storage container is in place. The lid sensor or the door sensor may be a push-button or other sensor. This determination prevents inadvertent running of a wash cycle or a traditional spin cycle, while still allowing running of the freshening mode cycle.

In step 1130, the machine spins an impeller at a pre-determined speed, which promotes air movement inside the machine. In one embodiment, where the appliance is a top loading washing machine, the impeller is located at a bottom of the wash extraction basket. In another embodiment, where the appliance is a front-loading washing machine or a front-loading dryer, the impeller may include one or more portions of a horizontally disposed wash basket and/or dryer basket. In step 1135, the machine operates the impeller spin mode at a pre-determined interval and for a pre-determined duration while in the freshening mode. The impeller may spin in only one direction or may stop and spin in the other direction in order to change the airflow direction. This happens several times during the freshening mode depending on the length of time the machine is put into freshening mode. While the impeller spins, the basket remains stationary, commonly referred to as wash mode on typical top load washing machines. In this embodiment, there is no water in the basket. Typical operation of the impeller occurs when the clothes are saturated with water and agitation action is imparted by the impeller to the clothes. In this embodiment, the impeller spins with no water in the basket and creates air circulation as described. In another embodiment, the basket and impeller spin together to create airflow inside the wash chamber. This type of operation is typically referred to as spin mode to one familiar with the industry. In step 1140, the movement of air promotes movement of the fragrance provided by the contents of the freshener pocket located in the storage container. In step 1145, the fragrant air mixes with articles in the storage container to minimizes bad odors and freshen the articles being stored inside the washing machine (or dryer). In step 1150, the freshening mode stops after a predetermined cycle time and/or when the user opens the lid or door of the washing machine (or dryer).

Thus, while there has been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

What is claimed is:

1. A laundry appliance, comprising:

a cabinet defining an opening having a diameter;

a processor;

a control panel coupled with the processor;

a container sensor coupled with the processor; and a storage container, the storage container comprising a rigid rim configured to span the opening of the cabinet, the rim having a diameter greater than the diameter of the opening and configured to rest proximate thereto; and a body attached to the rim, the body having a predetermined shape configured to rest through the opening of the cabinet;

wherein the processor is configured to receive a signal outputted by the sensor to initiate or prevent a cycle activation of the laundry appliance based on whether the storage container is in the laundry appliance.

2. The laundry appliance of claim 1, wherein the laundry appliance is at least one of a front load clothes washing machine, a top load clothes washing machine, a front load clothes dryer, and a top load clothes dryer.

3. The laundry appliance of claim 1, wherein storage container further comprising at least one handle connected to the rim.

4. The laundry appliance of claim 3, wherein the handle is recessed within the rim of the storage container.

5. The laundry appliance of claim 3, wherein the handle is moveably connected to the rim in the form of at least one of a pop-up handle and a pivot handle.

6. The laundry appliance of claim 1, wherein the storage container sensor is one of a proximity switch and a reed switch.

7. The laundry appliance of claim 1, wherein the storage container further comprises a magnet pocket.

8. The laundry appliance of claim 1, wherein the storage container further comprises protrusions to support the container sensor.

9. The laundry appliance of claim 1, wherein the storage container further comprises a deodorizing compartment.

10. The laundry appliance of claim 1, wherein the body is a rigid basket.

11. The laundry appliance of claim 1, wherein the body is flexible laundry bag.

12. The laundry appliance of claim 1, wherein the storage container further comprises a ring that provides a surface for the storage container to rest on a bottom of a wash basket of the laundry appliance.

13. The laundry appliance of claim 1, wherein the storage container further comprises sidewalls coupled with a bottom wall, wherein at least one of the sidewalls and the bottom wall have one or more holes formed therein to drain one or more articles placed within the storage container.

14. The laundry appliance of claim 1, wherein the storage container has a predetermined shape.

* * * * *